US005308077A

United States Patent [19]

Caggiano

[11] Patent Number: 5,308,077

[45] Date of Patent: May 3, 1994

[54] BOARD GAME

[76] Inventor: Jeffrey J. Caggiano, 284 Plantation St. #2, Worcester, Mass. 01604

[21] Appl. No.: 35,324

[22] Filed: Mar. 22, 1993

[51] Int. Cl.[5] ..... A63F 3/00

[52] U.S. Cl. ..... 273/243; 273/145 A

[58] Field of Search ..... 273/243, 144 R, 145 A, 273/145 D, 145 E

[56] References Cited

U.S. PATENT DOCUMENTS

| | | | |
|---|---|---|---|
| 2,996,833 | 8/1961 | Giuliano | 273/145 R |
| 3,193,071 | 7/1965 | Stanton | 273/145 E |
| 4,687,199 | 8/1987 | Aguirregomezcorta | 273/145 E X |
| 5,004,244 | 4/1991 | Johnson | 273/145 A |
| 5,024,440 | 6/1991 | Tidalgo et al. | 273/145 A |

*Primary Examiner*—William Stoll

*Attorney, Agent, or Firm*—S. Michael Bender

[57] ABSTRACT

A board game includes a game board over which game pieces move across squares identifying different categories of questions. The game also includes a timer, dice, a dice thrower, and several categories of question cards.

2 Claims, 4 Drawing Sheets

BOARD GAME

BACKGROUND OF THE INVENTION

1. Field of the Invention

The present invention relates to board games and more particularly pertains to a board game which tests both the luck and mental talent of an individual.

2. Description of the Prior Art

Playing board games is one of the most popular past times in the nation. Each year, millions of people participate in the simulated struggles, contests and outright warfare that inventive board games offer. Parties, overnight trips, and rainy afternoons make perfect occasions for playing board games where pitting luck and skill against an opponent can provide entertainment for hours. Some of the contemporary games offered today enjoy unparalleled prominence because they offer a unique combination of fresh topics and imaginative plots.

There are a large number of U.S. patents directed to board games. A typical example is to be found in U.S. Pat. No. 4,900,031 issued to Wohl which discloses a board game in which the players travel around a peripheral path on the board. There are two stacks of cards, one containing first name initials and the other containing last name initials. The player must name a famous person having the first and last name initials. When the player does so, he is awarded a point. Play continues for a specified period of time, and the winner is determined by the total number of points.

There is also a game commonly sold under the trademark "Trivial Pursuit." In this game, players travel around a board by rolling die. Each space is associated with a particular category. For example, in the Silver Screen Edition, the categories are settings, titles, off screen, on screen, production and portrayals. Upon landing on a space, the player is asked a question. If answered correctly, the player roles again. There is only one headquarter space for each category. When the player lands on a headquarter space, and answers the question correctly, he receives a wedge, thereby fulfilling his obligations for that category. When all six wedges for all categories are obtained, the player then must move to the center of the board, and answer the question correctly to win.

The above mentioned games have a very limited number of possible answers. In this respect, the game according to the present invention substantially departs from the conventional concepts and designs of the prior art, and in so doing provides an apparatus primarily developed for the purpose of amusement.

As such, it can be appreciated that there exists a continuing need for new and improved games which can be used for amusement. In this regard, the present invention substantially fulfills this need.

SUMMARY OF THE INVENTION

In view of the foregoing disadvantages inherent in the known types of games now present in the prior art, the present invention provides an improved game. As such, the general purpose of the present invention, which will be described subsequently in greater detail, is to provide a new and improved board game and method of playing the game which has all the advantages of the prior art games and none of the disadvantages.

To attain this, the present invention essentially provides a board game which requires both talent and luck. A game board is marked with squares of different types, directing the player to select a card from a particular category or to take part in a group contest. The game also includes a timer, dice, a dice thrower, and several categories of cards. Game pieces are also used in the game.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game which has all the advantages of the prior art games and none of the disadvantages.

It is another object of the present invention to provide a new and improved board game which requires both luck and skill.

It is a further object of the present invention to provide a new method of playing a board game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
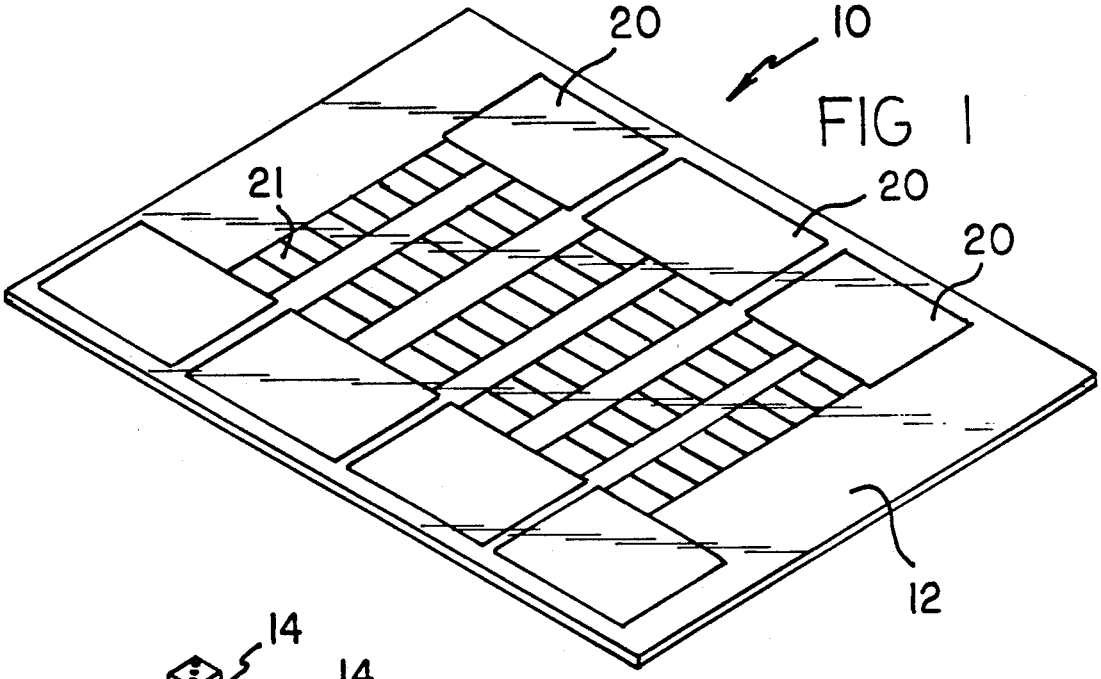
FIG. 1 is a perspective view of the game board of the present invention.
Figure 2:
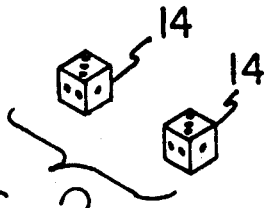
FIG. 2 is a view of the dice used in the present invention.
Figure 3:
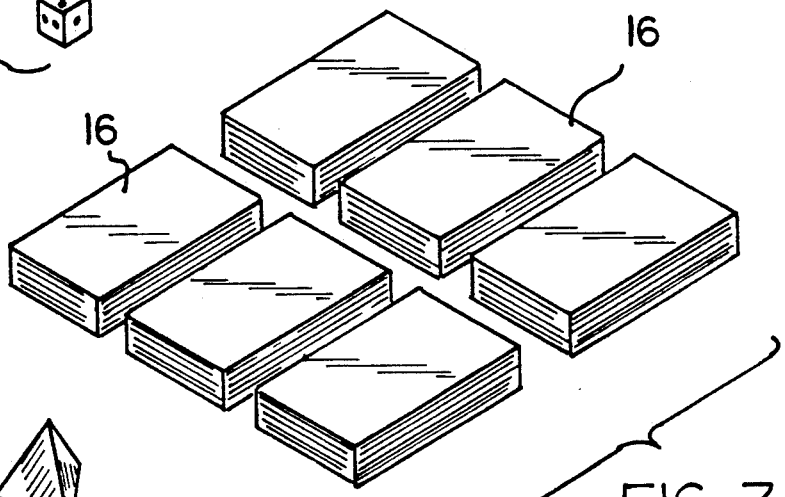
FIG. 3 is a view of the various stacks of cards used in the present invention.
Figure 4:
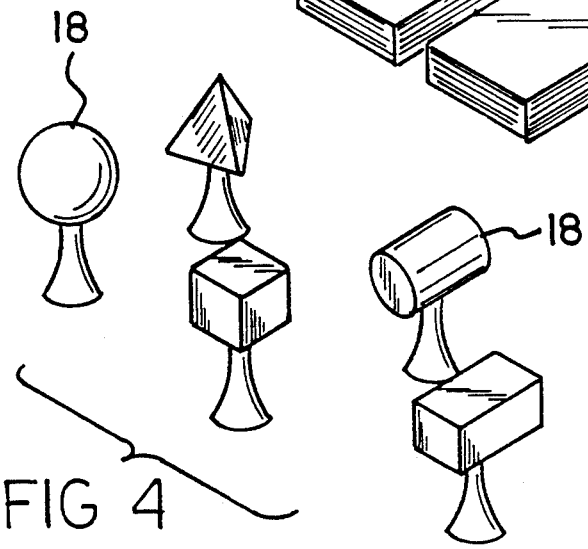
FIG. 4 shows examples of the game pieces used in the present invention.
Figure 5:
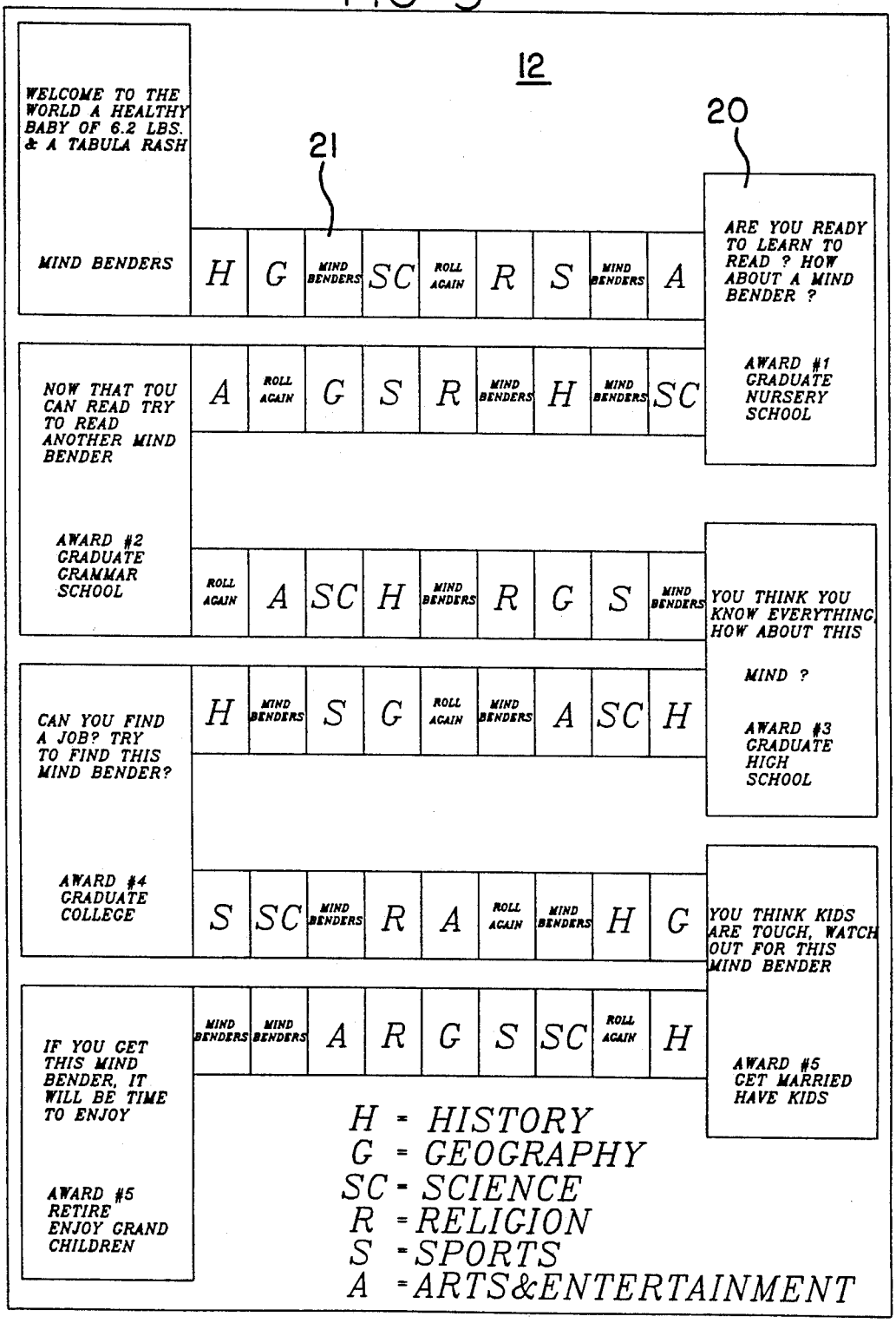
FIG. 5 is a detailed view of the game board of the present invention.
Figure 6:
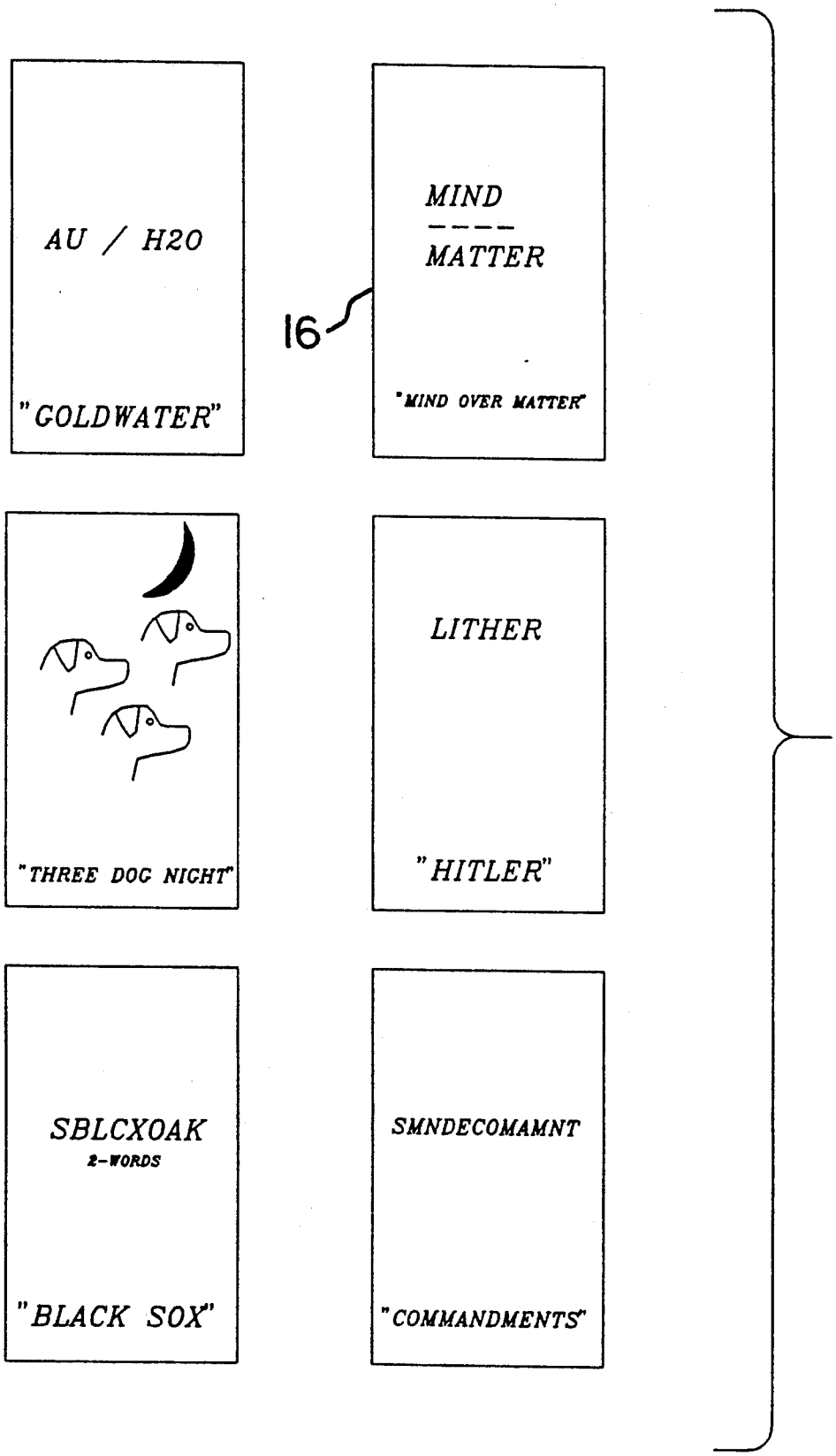
FIG. 6 shows samples of the cards used in the present invention.

With reference now to the drawings, and in particular to FIGS. 1–6 thereof, a new and improved board game embodying the principles and concepts of the present invention and generally designated by the reference numeral 10 will be described.

More specifically, it will be noted that a game board 12 contains different types of squares such as the award squares 20 and the "Mind Benders" squares 21. The dice 14 are used as a random number generating means for determining the advancement of the playing pieces 18 around the board from space to space. The several stacks of cards 16 contain word play puzzles in the categories of history, geography, science, religion, sports, art and entertainment.

The focus of the game is to create a competition between two or more people or two or more groups of people to figure out the word play. The winner of the contest would then have an opportunity to roll the dice and move around the game board, the spaces of which would be history, geography, science, religion, sports, and arts and entertainment. As the team or person lands on these categories they have to answer another picture or word play that would be more difficult and based on that category. The team rolls again if they are correct and if not, another card is drawn for the competition between the teams. The team that answers the picture or word play from each category first wins.

The object of the "Mind Benders Game" is to defeat an opponent by reaching the final space on the board, which requires being one of the victors in a group competition. To reach the end of the game, the players must correctly identify the word puzzles presented to them. To begin, the players each select a card from one of six categories. When all players have selected a card and are ready to play, the cards are viewed simultaneously. The first player to correctly identify the puzzle will take the first turn. The winning player or team takes a turn rolling a die to advance a game piece over the board. The game board is marked with squares of different types, directing the player to select a card for a particular category or to take part in a group contest.

There are two different types of spaces for group contest. One is a "Mind Bender" space and requires only that all players participate in solving the word games at the same time. Once the turn has ended for the team which landed on the space, they may begin moving again at their next turn regardless of whether or not they've won. The second type of contest is an "awards" space which is different from the others in that the team that lands on the space must also win from that category.

Some cards are imprinted with a picture or a series of pictures which complete a thought or phrase. Scrambled words for given topics can also be shown. Compound words are a third possibility, that when organized in a desired manner, will symbolize the meaning of the correct answer.

Combined with the unpredictability of the game board, the bizarre complexity of the game cards, and the individual talent of the players, "Mind Benders" should have an almost infinite number of possible conclusions. "Mind Benders" will certainly be entertaining due to its wide variety of topics, requirement for aptitude, and the amusing game play strategy.

Rules of the game: All players start together at the "Mind Benders" square. Up to four players or four groups of players can play. Play starts with each player or team selecting a "Mind Benders" card. When everyone is ready, the card is simultaneously viewed. The first player or team to correctly guess, the word puzzle will go first. If a player or team makes an incorrect guess they will act as a judge for the remaining teams. In the event that no correct answer is obtained, then each player or team picks another card and the competition continues in the same way.

The winning player or team rolls the die and moves the appropriate number of spaces. When they land on one of the category spaces, they will pick a word scramble card from that category. They will be allowed two minutes to correctly decipher the word that will correspond with that category. If they answer correctly, they roll again. If time runs out, or they answer incorrectly, the player or team to their right will roll.

When a player or team lands on a "Mind Bender" space, the group competition that started the game will determine the next roll of the die. If the player or team that landed on the space does not win the competition, they will be allowed to move off the space when it is their turn to roll again. All players or teams must stop at award spaces when they roll enough or more to advance them to that spot. These spaces will be treated like "Mind Bender" spaces. The only difference is that the player or team must win a group competition before they will be allowed to roll again.

Figure 7:
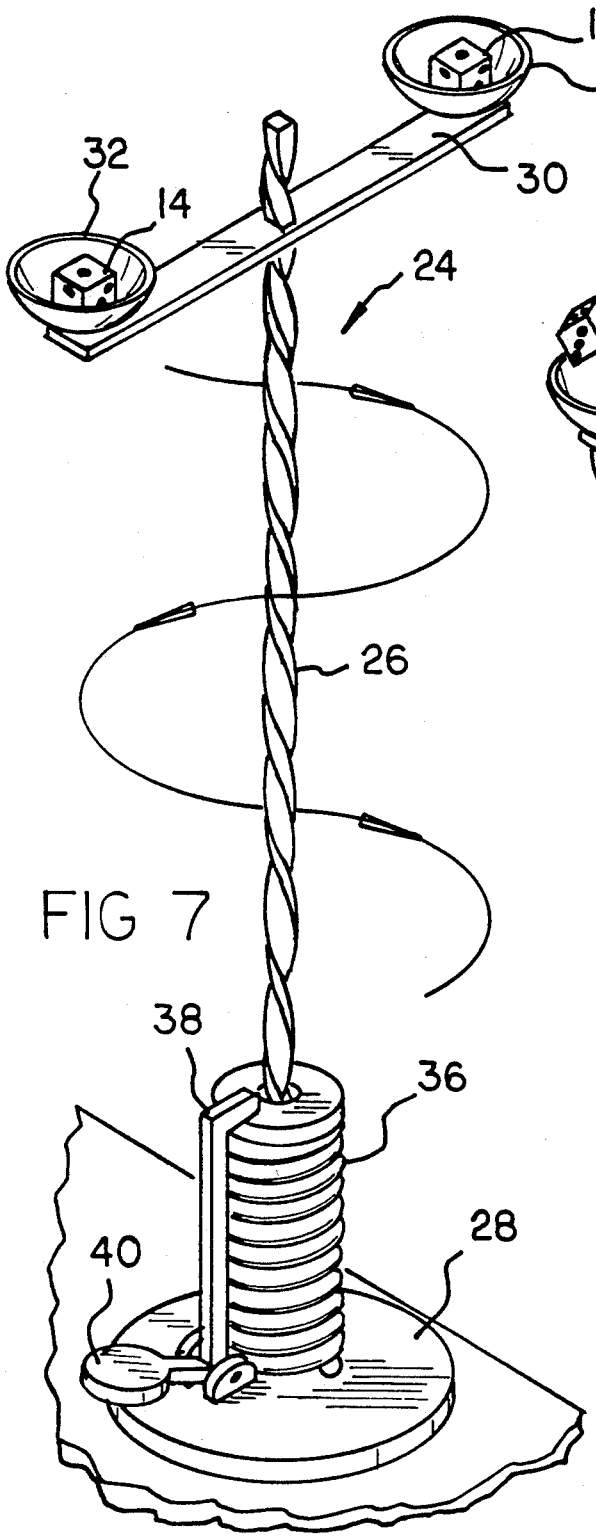
FIG. 7 shows a view of the dice thrower and mechanical timer of the present invention when being used as a timing device.
Figure 8:
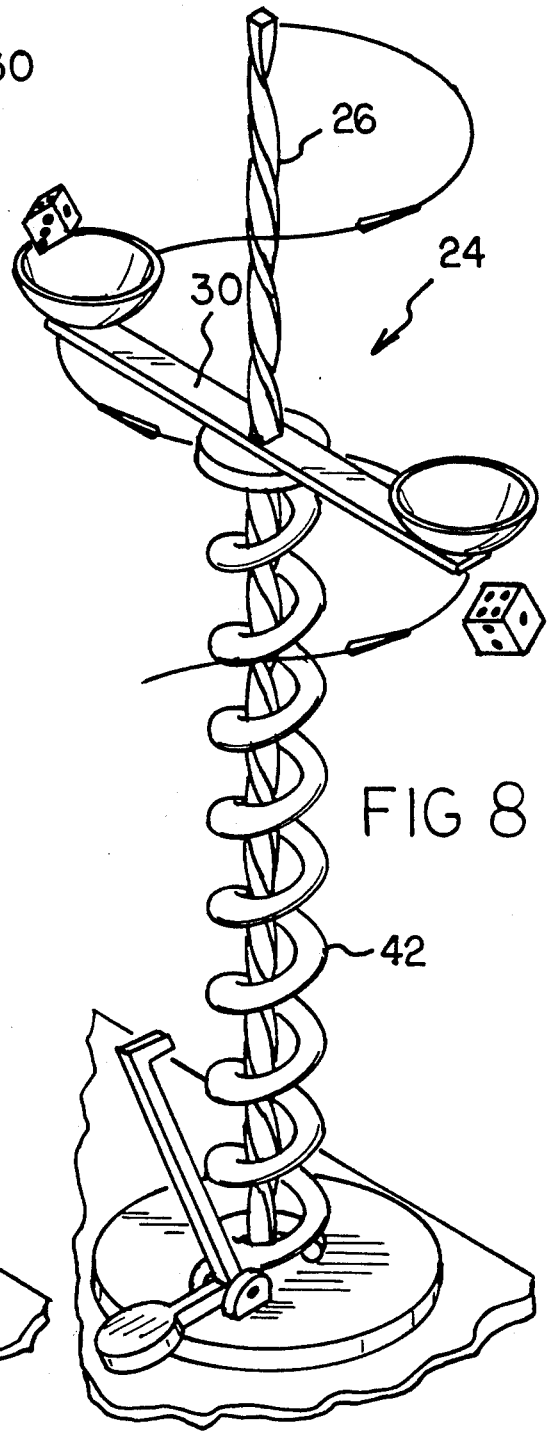
FIG. 8 shows a view of the mechanical timer and dice thrower of the present invention when being used in the dice tossing mode.

The present invention 10 also envisions the use of a combination timer and dice thrower which is generally designated by the reference numeral 24. This combination timer and dice thrower 24 is best illustrated in FIGS. 7 and 8. It can be seen that the device 24 includes a spiral rod 26 fixedly secured in an upstanding manner to a circular base member 28. A bar member 30 may be positioned over the spiral arm 26 and will rotate downwardly in a conventional manner and at a given speed in a well understood fashion. The bar member 30 includes a pair of cups 32, 34 disposed at opposite ends thereof, with these cups being designed to hold the dice 14 in the manner illustrated.

Additionally, a coiled spring 36 is normally retained in a compressed manner by a release arm 38 which may be activated by a trigger member 40. The trigger member 40 is utilized to effectively move the release arm 38 whereby the spring 36 can be released into an uncoiled position 42 as best illustrated in FIG. 8.

In use, the timer and dice thrower 24 is utilized to either provide a desired amount of time for a player to answer a question or alternatively to effect a tossing of the dice 14. The timer mode is best illustrated in FIG. 7 wherein the spring 36 is retained in a coiled position and the bar member 30 is allowed to rotatably progress down the spiral arm 26. The downward movement of the bar 30 will be at a controlled speed and it will be understood that an answer to a question must be accomplished before the bar member strikes the top of the coiled spring 36. This effectively allows the device 24 to function as a timer. When utilized as a dice thrower, reference should be had to FIG. 8 of the drawings wherein the arm 30 is allowed to progress down the spiral arm 26 and at any given moment, a player can depress the trigger 40 to effectively move the release arm 38 away from the coiled spring 36. The spring will rapidly uncoil so as to strike the bar member 30 which is at that moment rotating progressively down the spiral arm 26. This instant strike will effectively cause the two cups 32, 34 to jettison the dice 14 thus accomplishing the tossing function desired.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved board game comprising:
a game board;
at least one die;
at least one game piece for moving around said game board;
at least one category of question cards; and
a combined timer and dice thrower;
wherein said combined timer and dice thrower includes a spiral support arm, and a dice holding member,
said dice holding member mounted on said spiral support arm and being rotatable thereon, said dice holding member being selectively positionable on said support arm such that said dice holding member may descend along said support arm from a selected first position to a second position during a predetermined interval of time so as to provide a means for timing rate of play by a player.

2. The new and improved board game as described in claim 1, and further including a compression spring mounted around said spiral support arm, said compression spring being designed to be released to effectively strike said dice holding member, thereby to effect a throwing of said dice.

* * * * *